US005682793A

United States Patent [19]

Liao

[11] Patent Number: 5,682,793

[45] Date of Patent: Nov. 4, 1997

[54] ENGAGED ROTOR

[76] Inventor: Zhenyi Liao, 103 Fu 4 Hualu St., Yunxi Town, Sichuan Province 618408, China, 618408

[21] Appl. No.: 604,970

[22] PCT Filed: Sep. 19, 1994

[86] PCT No.: PCT/CN94/00073

§ 371 Date: May 9, 1996

§ 102(e) Date: May 9, 1996

[87] PCT Pub. No.: WO95/08698

PCT Pub. Date: Mar. 30, 1995

[30] Foreign Application Priority Data

Sep. 21, 1993 [CN] China ..... 93 1 11972.3

[51] Int. Cl.[6] ..... F16H 55/08; F16H 39/36; F01C 1/20

[52] U.S. Cl. ..... 74/462; 418/150; 418/191

[58] Field of Search ..... 74/462; 418/150, 418/191

[56] References Cited

U.S. PATENT DOCUMENTS

| | | | |
|---|---|---|---|
| 2,870,752 | 1/1959 | Breelle | 123/13 |
| 3,574,491 | 4/1971 | Martin | 418/205 |
| 3,782,340 | 1/1974 | Nam | 418/191 X |
| 4,747,762 | 5/1988 | Fairbairn | 418/191 |

FOREIGN PATENT DOCUMENTS

| | | |
|---|---|---|
| 0432287 | 6/1991 | European Pat. Off. . |
| 2330992 | 1/1975 | Germany . |
| 3324485 | 1/1985 | Germany . |
| WO 91/02888 | 3/1991 | WIPO . |

*Primary Examiner*—Allan D. Herrmann

*Attorney, Agent, or Firm*—Baker, Donelson, Bearman & Caldwell

[57] ABSTRACT

The present invention relates to a pair of meshed involute gears one of which has work teeth, their tooth-tip circle is larger than that of the said gear, the other has the grooves engaged with the said working teeth. The working teeth and the grooves have the same characters of equal periphery of meshing and rotating as the said involute gears. This composite construction of the gear named "the meshing type rotors" can be used in making internal combustion engine, fluid (liquid or gasous) pump and motor, vacuum pump, conditioner/refrigerator/compressor and hydraulic variator.

6 Claims, 12 Drawing Sheets

ENGAGED ROTOR

FIELD OF THE INVENTION

This Invention concerns a pair of engaged rotors. Either rotor possesses respectively involute teeth that can mesh with the other and rotate, on one rotor there is working tooth whose height is larger than that of the involute tooth, and on other rotor there is engaged tooth groove whose form corresponds with that of the working tooth so that they can engage with each other in course of rotation. The form of the said working tooth and its corresponding groove are made up of special curves. The said pair of such rotors can be applied as rotor of fluid pumps, vacuum pumps and/or fluid motors (liquid motor or gas motor), as well as the rotor of special rotary internal combustion engines.

BACKGROUND OF THE INVENTION

The existing gear pump is structured in a pair of toothed wheels called rotors meshing with each other and rotating in the casing. This kind of pump pumps in or out fluid through the cavity between the teeth. Due to the fact that the cavity of the pump is not continuous and its bulk is not large enough and that there always survives some compressed fluid between the meshed teeth, the gear pump is not applicable in pumping gases.

A PCT application for "Rotatory Internal Combustion Engine" (International application No. PCT/BR90/00008; International application date: Aug. 16th, 1990; International patent No. WO90/02888; International patent publishing date: Mar. 7, 1991) publishes a kind of rotor used in the rotary internal combustion engine. This rotor, however, doesn't possess meshed and rotating involute teeth and the application itself gives no function formula describing the form of the working tooth and its corresponding tooth groove.

German patent application (Application No. DT.A.2330992) discloses a kind of rotor, which does possess the meshed and rotating involute teeth, working tooth and engaged tooth groove. But, like the PCT one, it publishes no function formula describing the form of the working tooth and its corresponding tooth groove. It doesn't give any detailed information on the structure of the working tooth and the tooth groove, either. In addition, the uniform rotation velocity cannot be assured when they mesh with each other.

The present invention, however, aims to present a pair of engaged rotors, along whose excircle circumferences there exist the involute teeth, the working teeth and its corresponding tooth grooves which mesh appropriately with each other and rotate, and the form of the latter two are defined by special function formulae, when the working tooth meshes with the engaged tooth groove and rotates, they have the same characteristic of equal circumferential rotation as involute tooth.

SUMMARY OF THE INVENTION

The present invention presents a pair of engaged rotors which consist of an engaged wheel, along whose excircle circumference there exist the involute teeth and the engaged tooth grooves, and of a working wheel, along whose excircle circumference there exist the involute teeth and the working teeth. The height of the working tooth is larger than that of the involute tooth and the depth of the engaged tooth groove is also larger than that of the interval between the involute teeth. The pair of rotors, which can engage with each other and rotate in a casing, characterized in that, the form of the working tooth on the working wheel is defined by the following function formula:

$$\begin{cases} X_n = (R_a + R_b)\mathrm{Cos}(\alpha - \Psi - n\theta) - R_{b1}\mathrm{Cos}[\alpha + \beta - \Psi - n(i\theta + \theta)] \\ Y_n = R_{b1}\mathrm{Sin}[\alpha + \beta - \Psi - n(i\theta + \theta)] - (R_a + R_b)\mathrm{Sin}(\alpha - \Psi - n\theta) \end{cases}$$

the curve of the addendum circle thickness of the working tooth is defined by the arc corresponding to the included angle $2\Psi$, with the circle centre of the working wheel as the center and with $R_2$ as the radius. The formula is as follows:

$$\begin{cases} X = R_2\mathrm{Cos}\Psi \\ Y = R_2\mathrm{Sin}\Psi \quad (\Psi \to -\Psi) \end{cases}$$

the form of the said engaged groove on the engaged wheel is defined by the following function formula:

$$\begin{cases} X_n = (R_a + R_b)\mathrm{Cos}[i(\alpha - \Psi - n\theta)] - R_2\mathrm{Cos}[(\alpha - n\theta) + i(\alpha - \Psi - n\theta)] \\ Y_n = R_2\mathrm{Sin}[(\alpha - n\theta) + i(\alpha - \Psi - n\theta)] - (R_a + R_b)\mathrm{Sin}[i(\alpha - \Psi - n\theta)] \end{cases}$$

the bottom curve of the engaged groove is defined by the arc included by the angle ($2i\Psi$) corresponding to the included angle $2\Psi$ of the addendum thickness, and with the circle centre (which is that of the engaged wheel) as the circle center, and with the radius ($R_a$+$R_b$–$R_2$) as the radius. The formula is:

$$\begin{cases} X = (R_a + R_b - R_2)\mathrm{Cos}(i\Psi) \\ Y = (R_a + R_b - R_2)\mathrm{Sin}(i\Psi) \quad (\Psi \to -\Psi) \end{cases}$$

Along the circumference of the engaged wheel are uniformly distributed "nb" grooves while along that of the working wheel are uniformly distributed "na" working teeth. The arc defined by the angle "$\omega_{na}$" (included between the working teeth) and the radius "$R_a$" of the reference circle of the involute moth on the working wheel equals the arc defined by the angle "$\omega_{nb}$" (included between the engaged tooth grooves) and the radius "$R_b$" of the reference circle of the involute tooth on the engaged wheel. In this case, the following conditions must be satisfied:

$$\frac{\pi R_a \omega_{na}}{180°} = \frac{\pi R_b \omega_{nb}}{180°}$$

$$\omega_{na} = \frac{360°}{n_a}\ ;\ \omega_{nb} = \frac{360°}{n_b}$$

As stated above,

"$n_a$, $n_b$" are positive integers;

"$R_a$" stands for the radius of the reference circle of the involute tooth on Wheel A;

"$R_b$" stands for the radius of the reference circle of the involute tooth on Wheel B;

"$R_2$" stands for the radius of the addendum circle of the working tooth on Wheel A;

"$R_{b1}$" stands for the radius of the addendum circle of the involute tooth on Wheel B;

"a" stands for the distance between the intersection point of the line past Point "$R_d$" with its perpendicular Line O O' and the point of tangency of Circle $R_a$ with Circle $R_b$;

"i" stands for the gear ratio;

"Ψ" stands for the semiangle of the working tooth addendum thickness;

"γ" stands for the primal semiangle of the engaged tooth groove;

"θ" stands for a set constant;

"n" stands for n=0,1,2 . . . k, in which "k" is a natural number;

$$\text{"}\alpha\text{" stands for } \arccos\frac{R_a+a}{R_2};$$

$$\text{"}\beta\text{" stands for } \arccos\frac{R_b-a}{R_{b1}}.$$

Here it should be pointed out that if i=1, then $n_a=n_b$.

BRIEF DESCRIPTION OF THE DRAWINGS

FIG. 8: schematic diagram illustrating the relation of H, R, $R_f$ and a;

DETAILED DESCRIPTION OF THE PREFERRED EMBODIMENT

To begin with this, it should be made clear in the first the origin of the form and mathematical formula of the curves of the enaged groove and the working tooth. Suppose that there is a pair of wheels (A and B) in engaged rotation, whose modulus and number of tooth are equal and whose gear ratio "i" is 1 and for the convenience of inferring the formula, we simplify the pair of wheels to one fixed in the rectangular coordinate system where Point O serves as its centre point, and the other wheel revolves round the fixed one and on its own axis.

Figure 1:
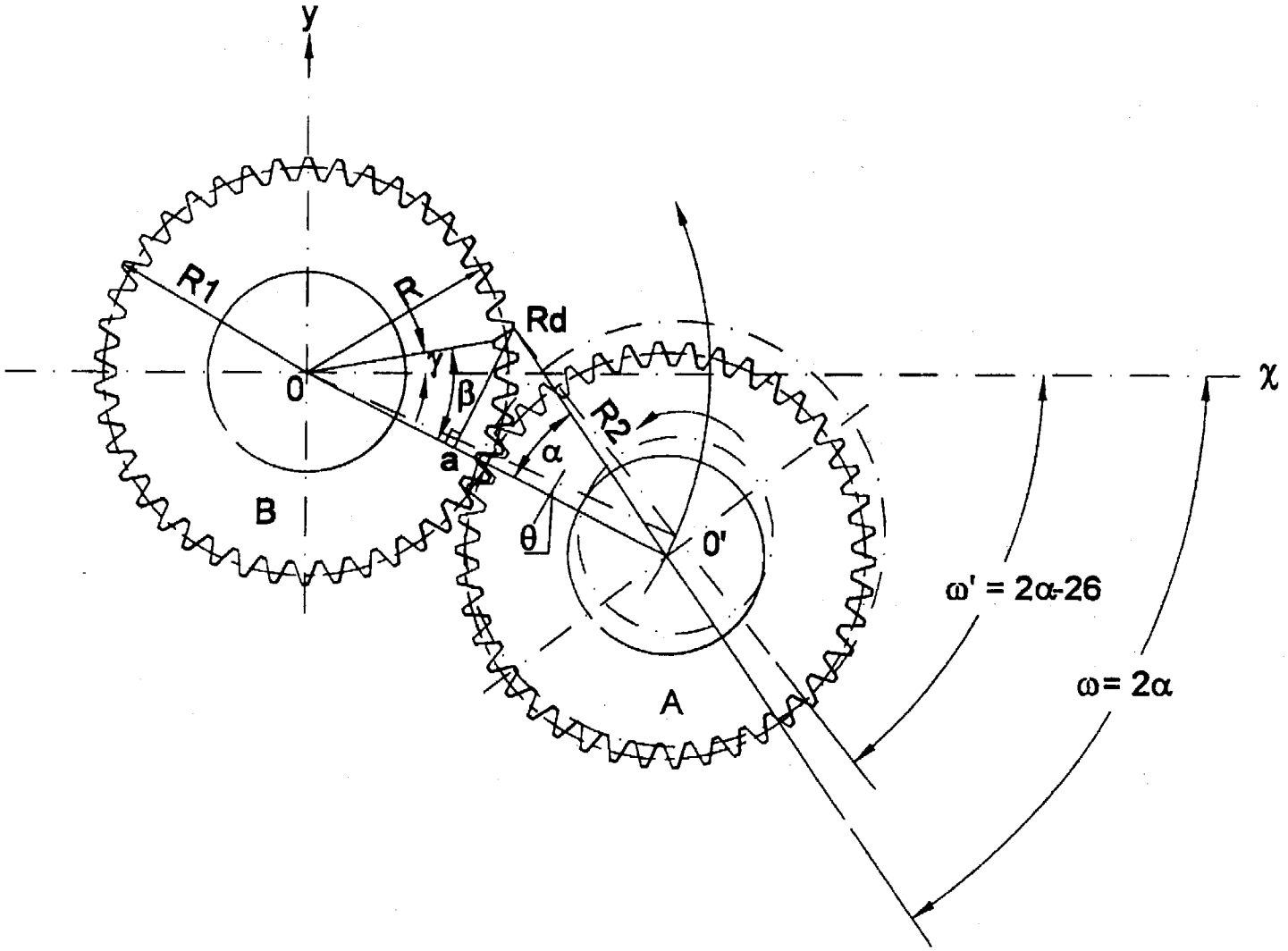
FIG. 1: schematic diagram illustrating the formation of the engaged groove curve.

In the rectangular coordinate system shown in FIG. 1, Point O is the centre of Wheel B:

$$\alpha=\arccos\frac{R+a}{R_2};\quad \beta=\arccos\frac{R-a}{R_1}$$

Let γ=β−α and wherein:

"R" stands for the radius of the reference circle of the involute toothed wheel;

"$R_2$" stands for the radius of the addendum circle of the working tooth on Wheel A;

"$R_1$" stands for the radius of the addendum circle of the invoulute tooth;

"γ" stands for the primal semiangle of the enaged tooth groove.

Here, Line $R_2$ on wheel A, which is greater than $R_1$, intersects the addendum circle of the involute tooth on Wheel B at point $R_d$.

Suppose the included angle by Line O'$R_d$ and Axis X is ω, then we have ω=β−γ+α=2α.

The centre ligature of Wheel A and Wheel B, "O O'" equals "2R", and the angle included by Line O O' and Axis X is β−γ=α.

If Wheel A revolves counter-clockwise around Wheel B by one "θ" angle, then the angle included by Line O O' and Axis X is "α−θ" and in the meanwhile, Wheel A revolves on its own axis by one "θ" angle. ∠O O, $R_d$=α−θ and ω'=2(α−θ).

As Wheel A revolves round Wheel B and on its own axis by "nθ" angle, the geometric locus "L" which is formed when the vertex of Line $R_2$ on Wheel A, point Rd, secants on the plane of Wheel B must coincide with the following formula:

$$\begin{cases} X_n = 2R\cos(\alpha-n\theta) - R_2\cos[2(\alpha-n\theta)] \\ Y_n = R_2\sin[2(\alpha-n\theta)] - 2R\sin(\alpha-n\theta) \end{cases} \quad (1)$$

in which

"$R_2$" stands for the radius of the addendum circle of the working tooth;

"$R_1$" stands for the radius of the addendum circle of the involute toothed wheel;

"R" stands for the radius of the reference circle of the involute toothed wheel;

"θ" stands for a setable constant, and $$\theta=\frac{\alpha}{n};$$

(n=0,1,2, . . . k, in which "k" being a natural number);

In Formula (1), if n=0, nθ=0, then Point $R_d$ of Line $R_2$ on wheel A is coincides with the start point "La" of the Locus "L" on Wheel B.

If nθ=α, then Line $R_2$ coincides with Axis X and point $R_d$ becomes the midpoint of Locus L.

Figure 2:
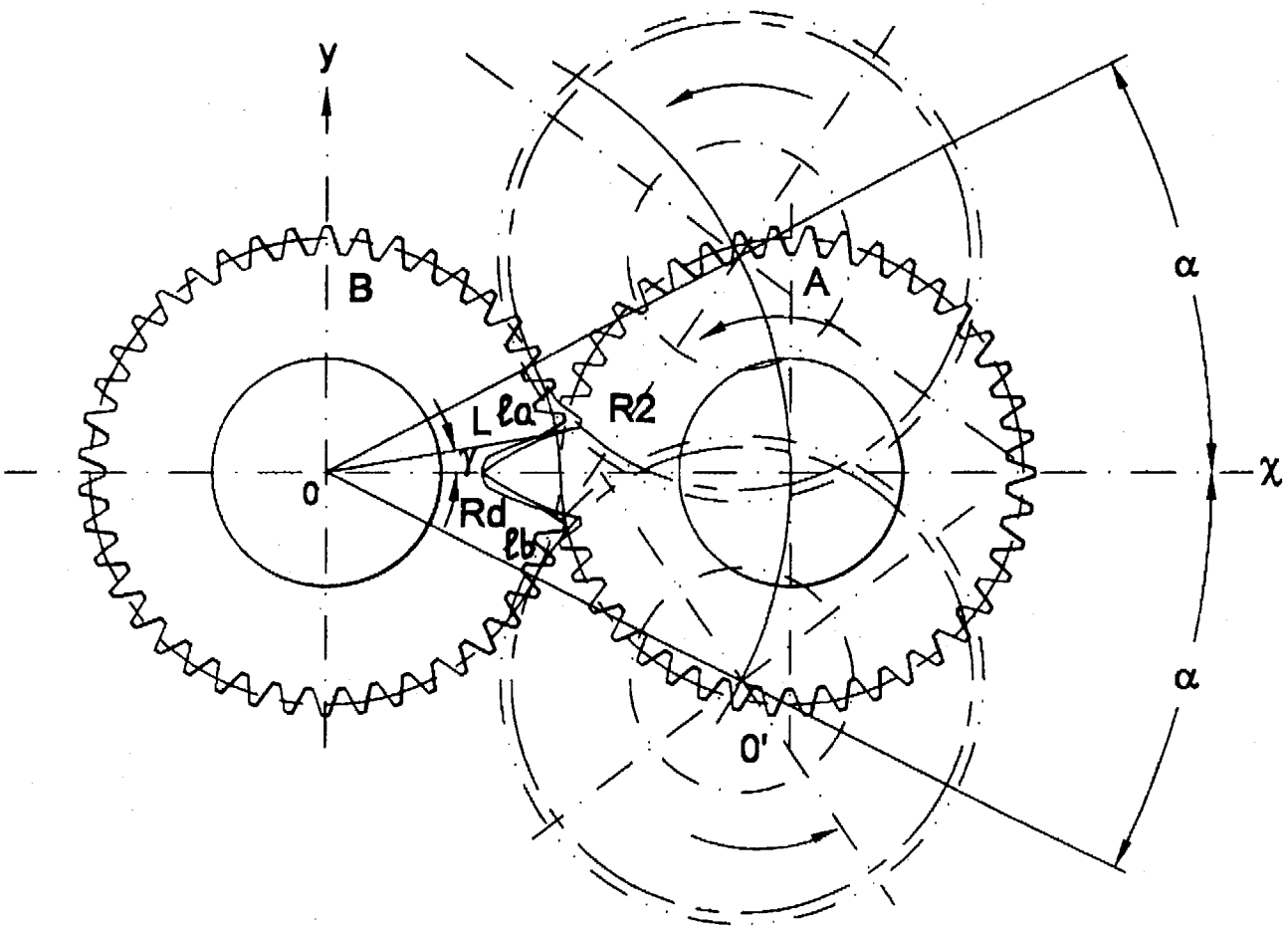
FIG. 2: schematic drawing of the engaged groove curve.

If nθ=−α, then point $R_d$ of Line $R_2$ on wheel A coincides with the end point "Lb" of Locus L and Line $R_2$ finishes its secanting on the plane of Wheel B (Viz. FIG. 2)

Figure 3:
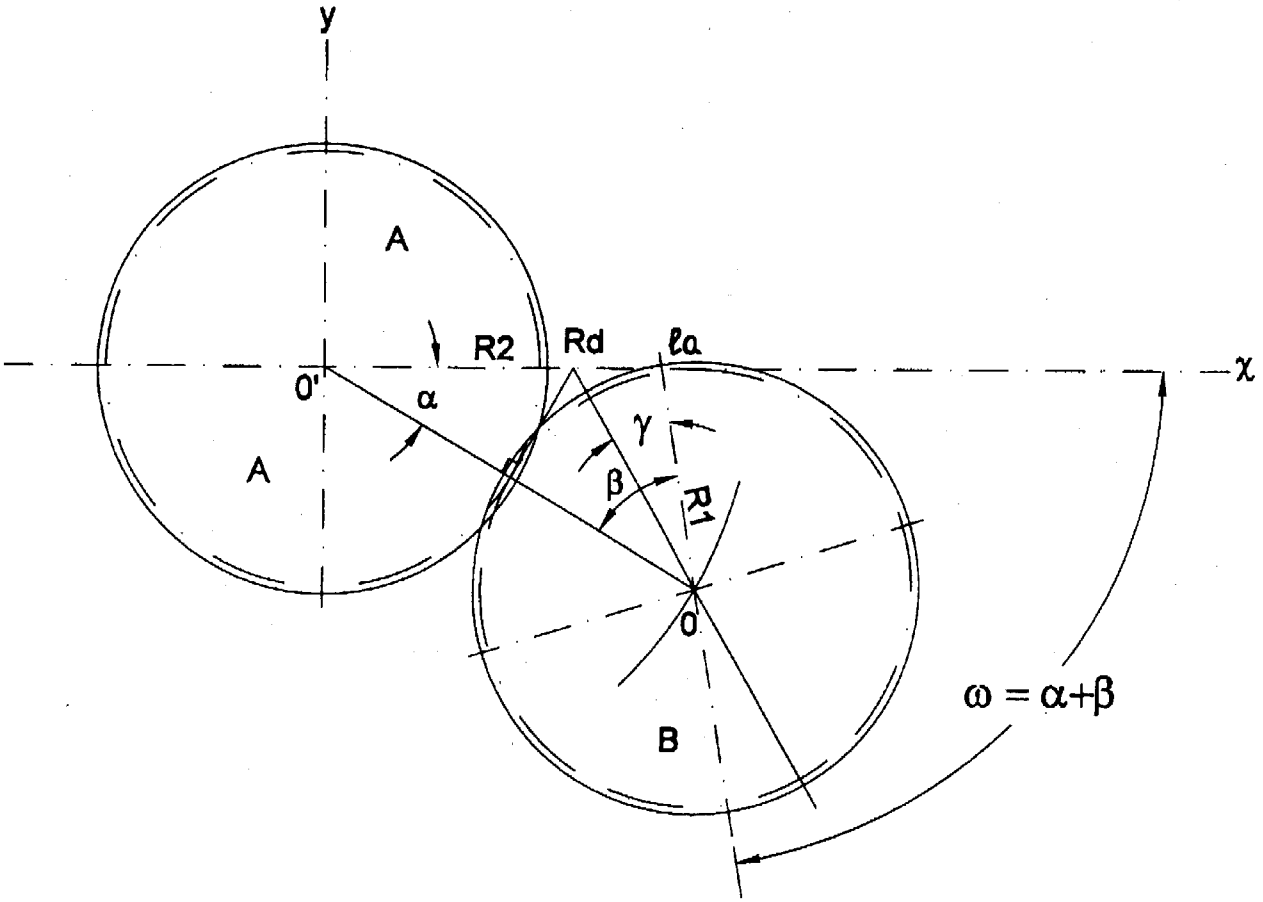
FIG. 3: schematic diagram illustrating the formation of the working tooth curve.

As shown in FIG. 3, suppose Wheel A is fixed in the rectangular coordinate system, Point "O'" as its centre, Line $R_2$ ($R_d$ O'=$R_2$) coincides with Axis X, the angle included by Line O O' and Axis X is α, Point Rd coincides with Point La (a point on the radius "$R_1$" of the addendum circle of Wheel B), the angle included by O La and Axis X is ω(ω=α+β) and after Wheel B revolves round Wheel A and on its own axis by "nθ" angles, ω'=α−nθ+β−nθ=α+β−2nθ, then we get $$\alpha=\arccos\frac{R+a}{R_2};\quad \beta=\arccos\frac{R-a}{R_1}$$

$$\gamma=\beta-\alpha$$

Figure 4:
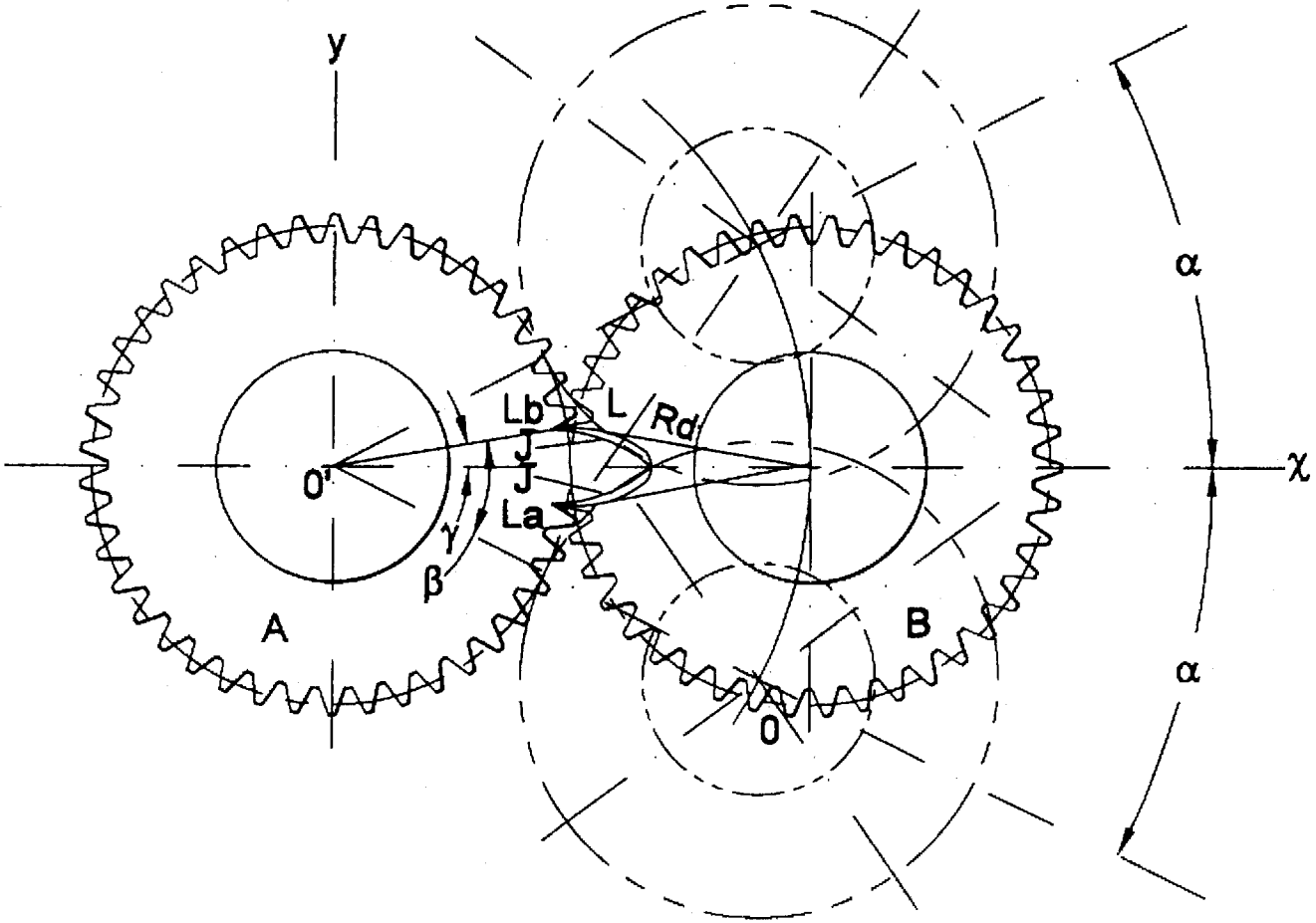
FIG. 4: schematic drawing of the working tooth curve.

While Wheel B revolves round Wheel A and on its own axis, Line R2 secants on the plane of Wheel B and Locus L on Wheel B (with La and Lb as its start point and end point respectively) starts to project on the plane of Wheel A two geometric locus "J" and "J'" (as shown in FIG. 4), which are explained in the following formula:

$$\begin{cases} X_n = 2R\mathrm{Cos}(\alpha - n\theta) - R_1\mathrm{Cos}(\alpha + \beta - 2n\theta) \\ Y_n = R_1\mathrm{Sin}(\alpha + \beta - 2n\theta) - 2R\mathrm{Sin}(\alpha - n\theta) \end{cases} \quad (2)$$

in which

"$R_1$" stands for the radius of the addendum circle of the involute toothed wheel;

"R" stands for the radius of the reference circle of the involute toothed wheel.

"θ" stands for a set constant, and $$\theta = \frac{\beta}{n}$$

(n=0,1,2 . . . k. k being a natural number)

In formula (2): if n=0. nθ=0, Point $R_d$ then coincides with the start point "La" of Locus L on Wheel B; if nθ=α, then the midpoint of Locus L is on Line $R_2$, i.e., on Axis X.

When α=β−γ (γ is the primal semiangle of the engaged groove), Formula (2) changes to $$\begin{cases} X = 2R\mathrm{Cos}0° - R_1\mathrm{Cos}\gamma \\ Y = R_1\mathrm{Sin}\gamma - 2R\mathrm{Sin}0° \end{cases} \quad (3)$$

When the start point "La" of Locus L goes all the way to the addendum circle $R_1$ on Wheel A, nθ=β. Formula (2) changes to $$\begin{cases} X = 2R\mathrm{Cos}(-\gamma) - R_1\mathrm{Cos}(-\gamma) \\ Y = R_1\mathrm{Sin}(-\gamma) - 2R\mathrm{Sin}(-\gamma) \end{cases} \quad (4)$$

At this stage Locus L on Wheel B finishes its projecting on the plane of Wheel A.

In brief, the ERM (Engaged Rotor Mechanism) is based on two wheels, Wheel A and Wheel B. As Wheel A revolves both around Wheel B and on its own axis, the vertex of Line $R_2$ on Wheel A, "Point $R_d$", secants on the plane of Wheel B and forms a geometric locus "L", which is called "the engaged groove curve" (Viz. Formula 1); and correspondingly, as Wheel B revolves round Wheel A and on its own axis, two curves are projected on the plane of Wheel A by the engaged groove curve "L", with La as its start point and Lb as its end point; these two projected curves "J" and "J'" forms the working tooth curve (Viz. Formula 2).

Figure 5:
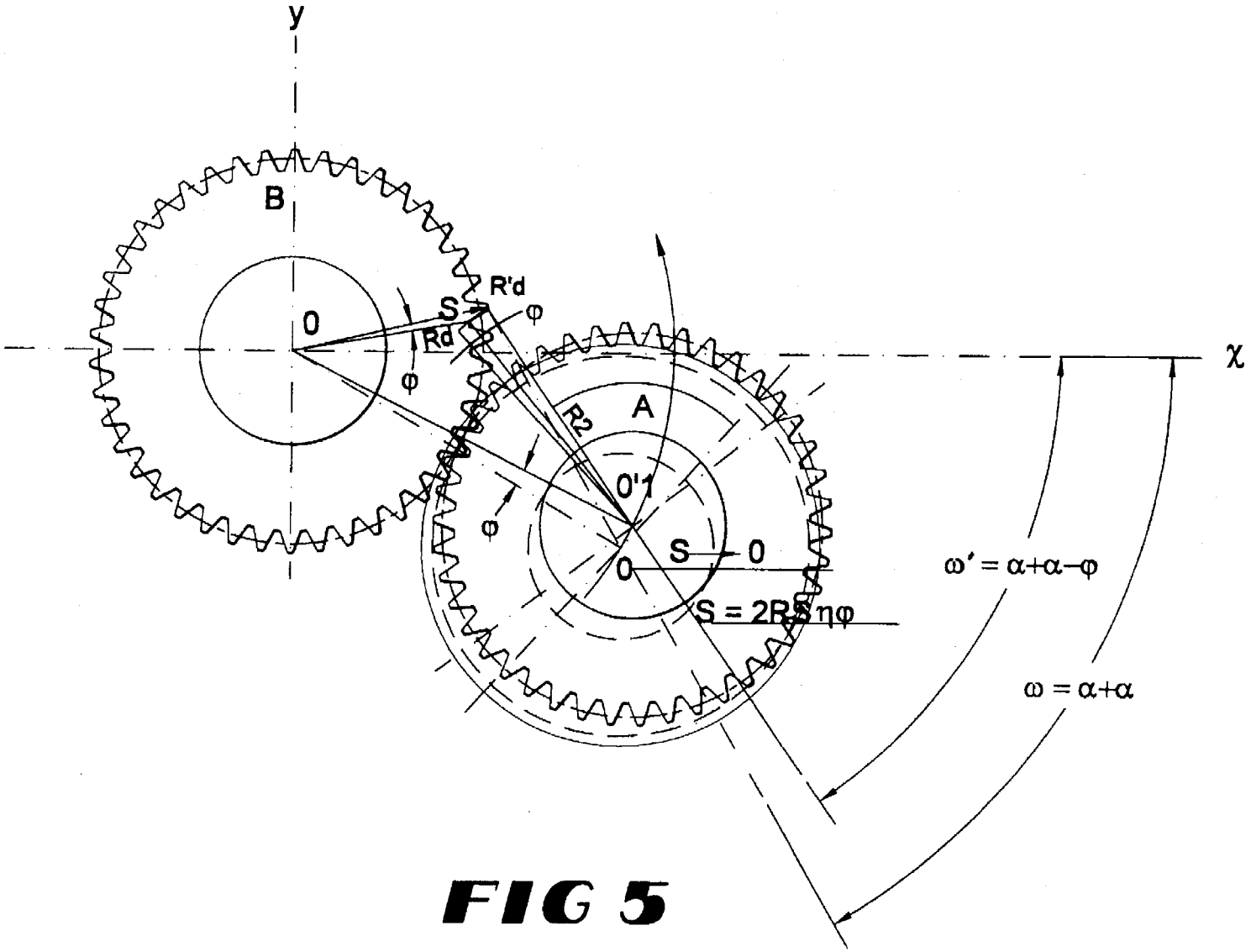
FIG. 5: schematic drawing illustrating the addendum thickness of the working tooth curve.

In Formula 2, suppose "J" and "J'" intersects at $R_d$ (as shown in FIG. 4), when the addendum thickness "S" approaches to zero. As the ERM is mainly applied in compressing gases and liquids or turning the compressing energy into torque, thicker sliding surface of the addendum "S" with the casing will yield better sealing effects. To attain this, let us suppose "J" and "J'" are turned back separately by one "Ψ" angle, then we can get the chordal tooth thickness $S=2R_2\mathrm{Sin}\Psi$ ($R_2$ is the distance between the working tooth addendum and the wheel centre). At the same time, one "Ψ" angle is added to the corresponding primal semiangle "γ" of the engaged groove. Look at the rectangular coordinate system in FIG. 5, as Wheel A revolves round Wheel B by one "Ψ" angle, Point $R_d$ of Line $R_2$ on Wheel A displaces to $R_d'$; when the angle included by Line O O' and Axis X is α−Ψ, ∠O O' $R_d$=α−Ψ, ∠O O' $R_d'$=α−Ψ+Ψ=α, and the angle included by Line O'$R_d'$ and Axis X is α=α+α−Ψ=2α−Ψ. Substitute them into Formula 1 and the formula for the engaged groove curve derives as follows:

$$\begin{cases} X_n = 2R\mathrm{Cos}(\alpha - \Psi - n\theta) - R_2\mathrm{Cos}[2(\alpha - n\theta) - \Psi] \\ Y_n = R_2\mathrm{Sin}[2(\alpha - n\theta) - \Psi] - 2R\mathrm{Sin}(\alpha - \Psi - n\theta)] \end{cases} \quad (5A)$$

The bottom curve of the engaged groove, i.e., the arc corresponding to Ψ that corresponds to the included angle 2Ψ of the addendum thickness, and with the circle center of the engaged wheel as the circle center, with $2R-R_2$ as the radius, is defined by the following formula:

$$\begin{cases} X = (2R - R_2)\mathrm{Cos}\Psi \\ Y = (2R - R_2)\mathrm{Sin}\Psi \quad (\Psi \to -\Psi) \end{cases} \quad (5B)$$

The formula for the working tooth curve derives from Formula 2 as follows:

$$\begin{cases} X_n = 2R\mathrm{Cos}(\alpha - \Psi - n\theta) - R_1\mathrm{Cos}(\alpha + \beta - \Psi - 2n\theta) \\ Y_n = R_1\mathrm{Sin}(\alpha + \beta - \Psi - 2n\theta) - 2R\mathrm{Cos}(\alpha - \Psi - n\theta) \end{cases} \quad (6A)$$

The curve of the working tooth addendum thickness, i.e., the arc corresponding to the included angle 2Ψ and with the circle center of the working wheel as the circle center, with $R_2$ as the radius, is defined by the formula below:

$$\begin{cases} X = R_2\mathrm{Cos}\Psi \\ Y = R_2\mathrm{Sin}\Psi \quad (\Psi \to -\Psi) \end{cases} \quad (6B)$$

Figure 6A:
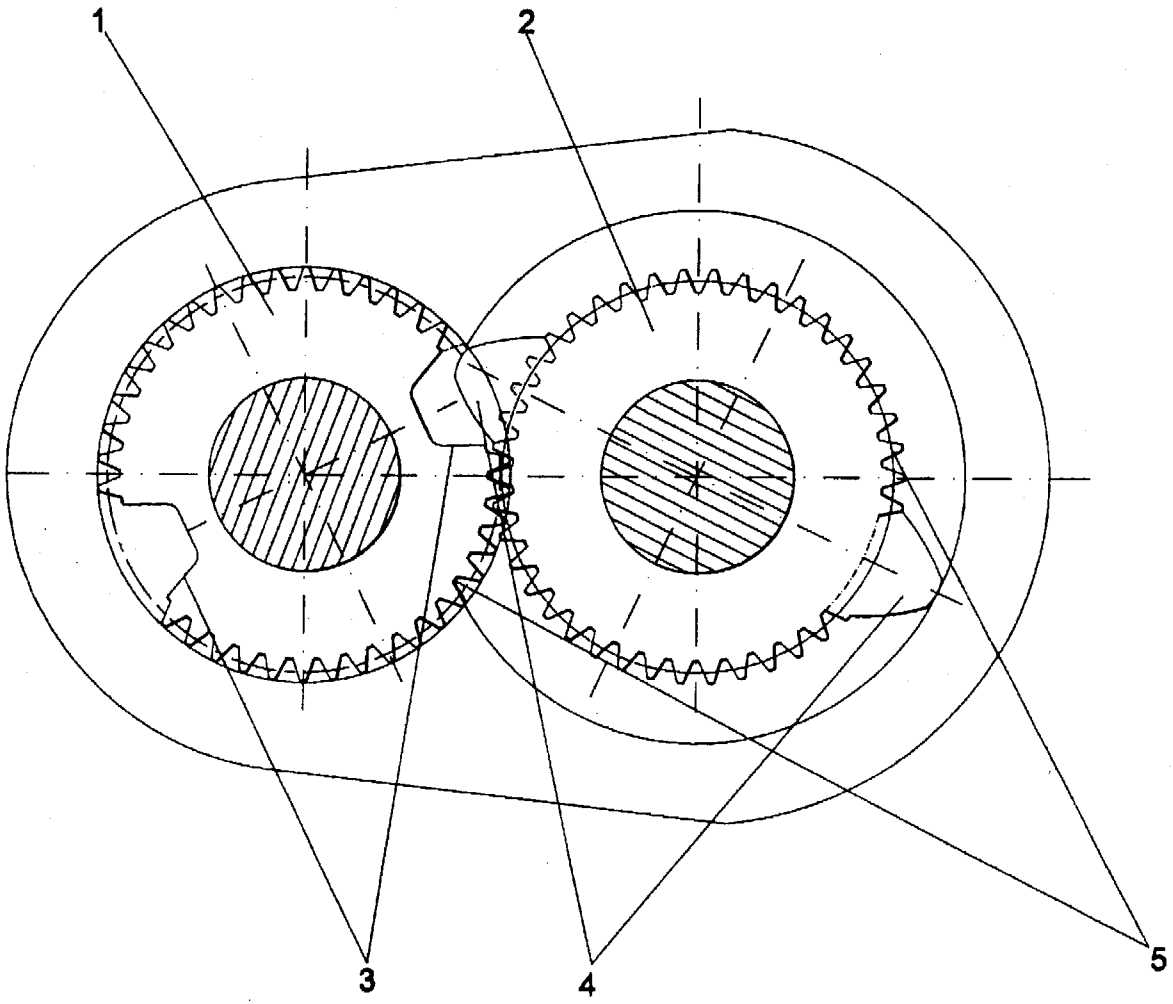
FIG. 6A: one demonstration of the basic structure of the engaged rotor mechanism (ERM) (1—engaged wheel; 2—working wheel; 3—engaged tooth groove; 4—working tooth; 5—involute tooth)
Figure 6B:
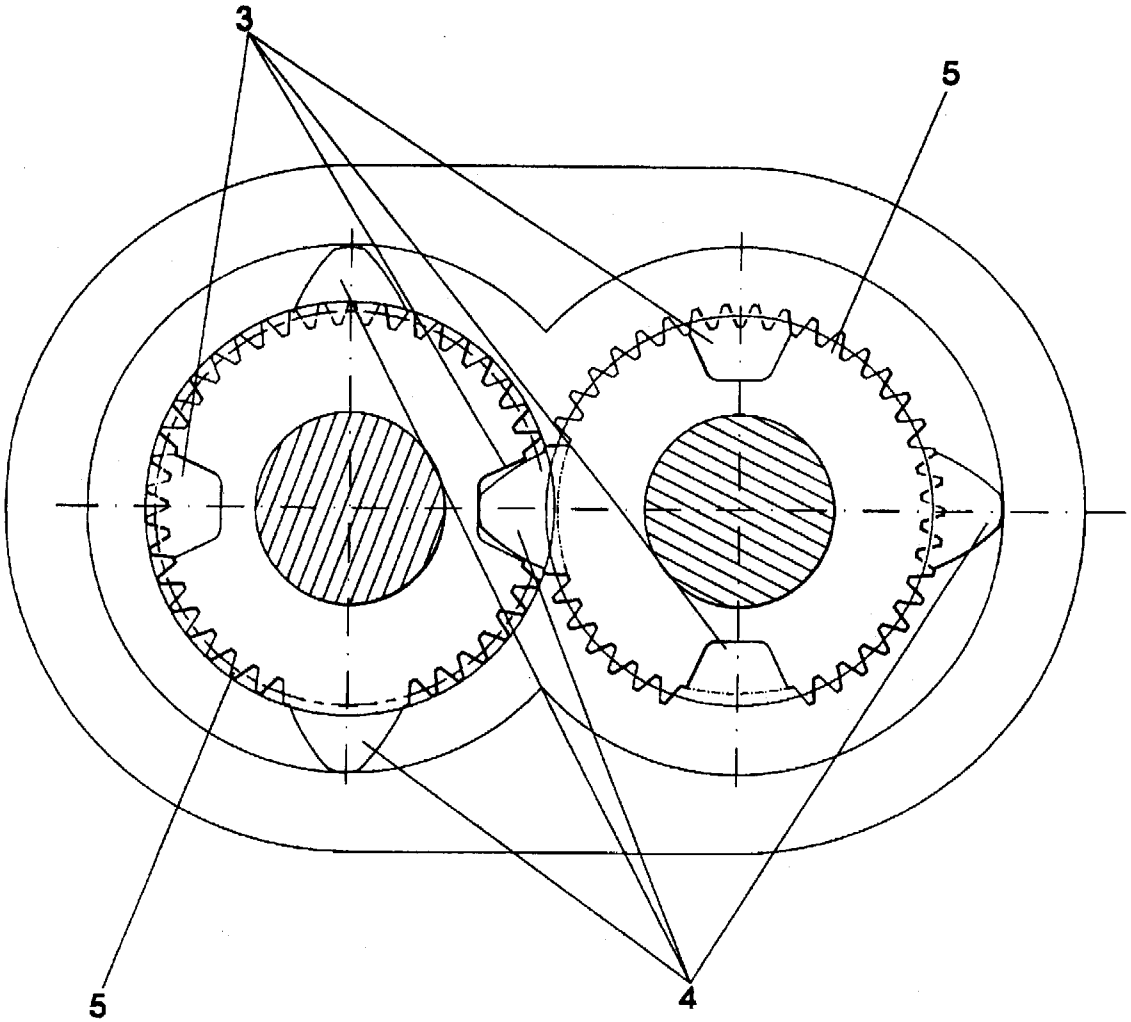
FIG. 6B: another demonstration of the basic structure of the ERM (3—engaged tooth groove; 4—working tooth; 5—involute tooth)

Hence, we get the mathematical models for the engaged groove (Formulae 5A and 5B) and the working tooth (Formulae 6A and 6B), in which the depth of the engaged groove is ($R_2$−R), the height of the working tooth is ($R_2$−R) and the addendum thickness of the working tooth is $S=2R_2\mathrm{Sin}\Psi$. The said engaged groove and working tooth, which can engage with each other and rotate at 2Rπ by equal circumference, combine with the involute teeth to constitute a kind of practical machinery (as shown in FIGS. 6A and 6B).

The ERM is a kind of rotatory mechanism. In order to balance its mass, it would be better to design it as perfectly centre symmetric, i.e., uniform in interval circumference. (Its basic structure is illustrated in FIGS. 6A and 6B).

Figure 7A:
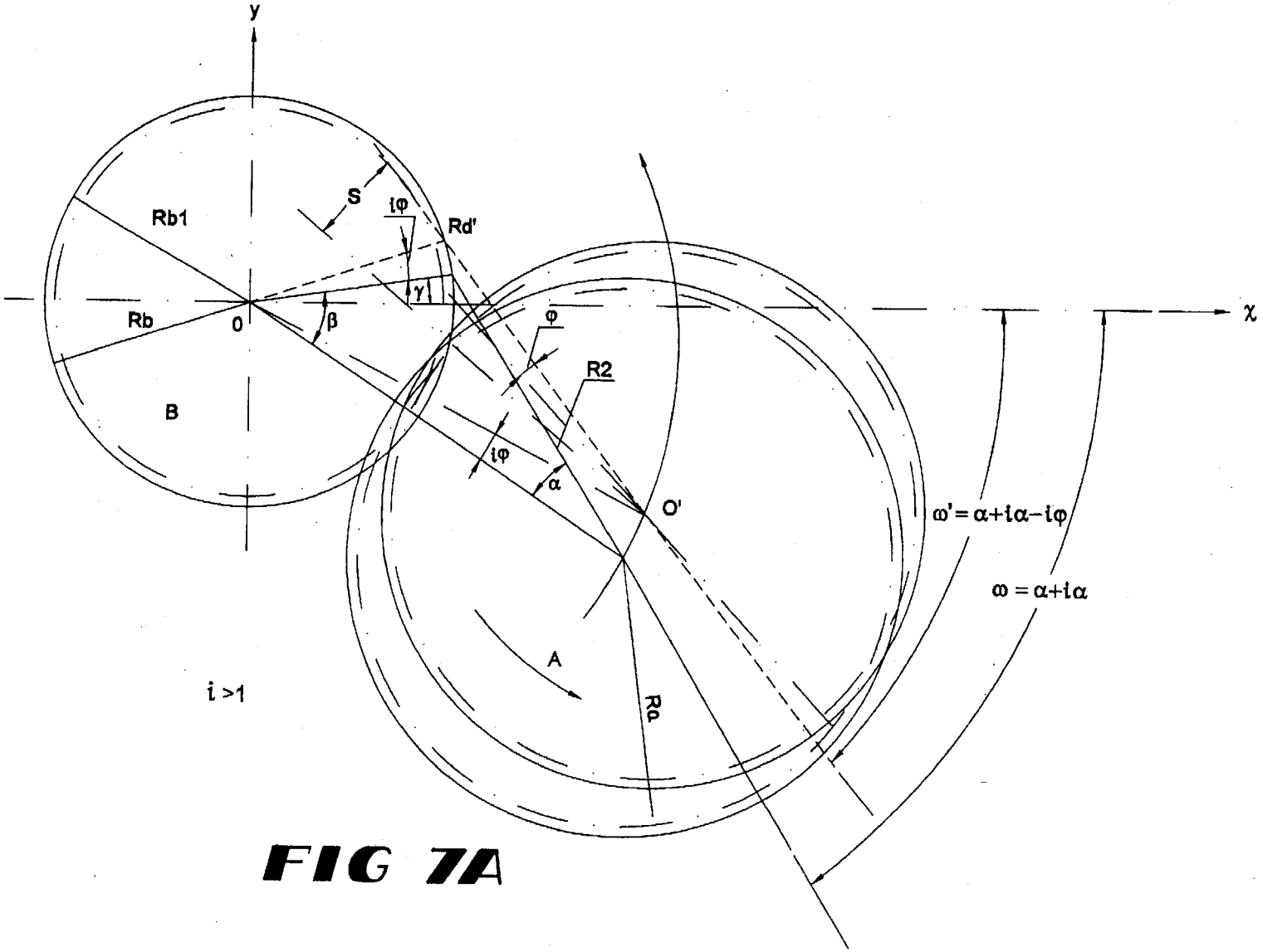
FIG. 7A: schematic diagram illustrating the relation of the parameters occurring in the engaged rotation of the working tooth with the engaged tooth groove when i>1.
Figure 7B:
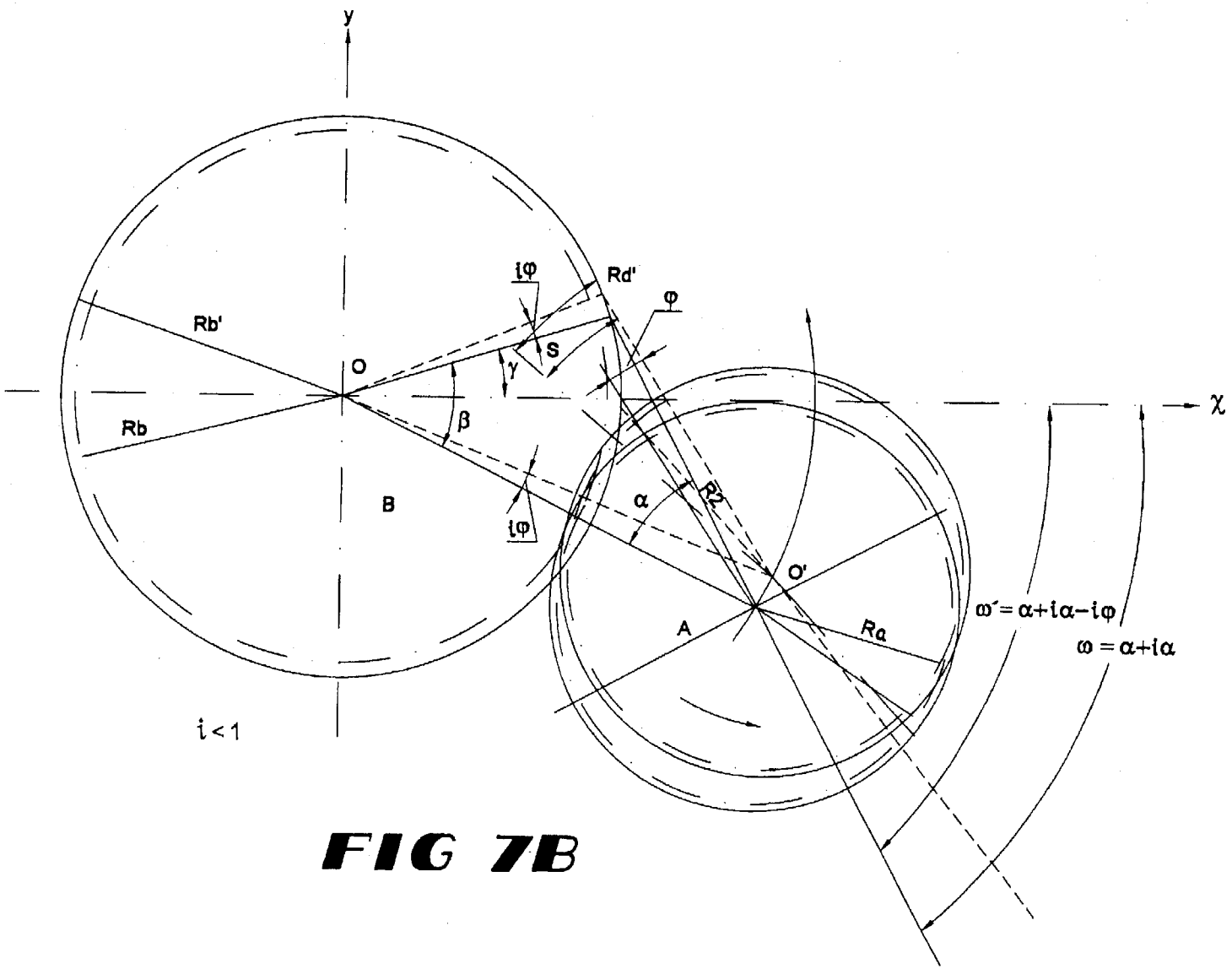
FIG. 7B: schematic diagram illustrating the relation of the parameters occurring in the engaged rotation of the working tooth with the engaged tooth groove when i<1.

If the gear ratio i≠1, the following formula has to be abode by to enable Wheel A to revolve round Wheel B on the basis of equal circumference rotation of the meshed toothed wheel:

$$\frac{\pi R_a \alpha}{180°} = \frac{\pi R_b(\beta - \gamma)}{180°},$$

from which we derives (Viz. FIGS. 7A and 7B):

$$R_a\alpha = R_b(\beta - \gamma)$$

When the angle of revolution β−γ=0 and the rotation angle of wheel A on its own axis α=0, Line $R_2$ on Wheel A coincides with Axis X.

$$\text{For } \frac{R_a}{R_b} = i,$$

then iα=β−γ, $$\text{or } \frac{\pi R_a \alpha}{180°} = \frac{\pi R_b i\alpha}{180°}$$

As illustrated in FIGS. 7A and 7B, if i≠1, in order to obtain addendum thickness of the working tooth $S=2R_2\mathrm{Sin}\Psi$, Wheel A must revolve round Wheel B by one iΨ angle and the primal angle "γ" of the engaged tooth groove must be enlarged by one iΨ angle to have $R_d'$ intersect with the exradius "$R_{b1}$" of Wheel B. At this time, the angle included by Line O O' with Axis X is: $i\alpha-i\Psi=i(\alpha-\Psi)$. Since ∠O O' $R_d=\alpha-\Psi$, ∠O O' $R_d'$=∠O O' $R_d+\Psi=\alpha$, the angle included by Line O'$R_d'$ and Axis X is $\omega=\alpha+i(\alpha-\Psi)$, i.e., $$\frac{\pi R_a(\alpha-\Psi)}{180^\circ}=\frac{\pi R_b i(\alpha-\Psi)}{180^\circ}$$

in which

"$R_a$" is the radius of the reference circle of the involute tooth on Wheel A;

"$R_b$" is the radius of the reference circle of the involute tooth on Wheel B;

"γ" is the primal semiangle of the engaged groove;

"iΨ" is the semiangle of the engaged groove corresponding to the semiangle of the working tooth addendum thickness;

"Ψ" is the semiangle of the working tooth addendum thickness.

As Wheel A revolves round Wheel B by one iθ angle, the angle included by Line O O' with Axis X is $i(\alpha-\Psi-\theta)$; and as Wheel A revolves on its own axis by one θ angle, ∠O O'$R_d'=\alpha-\theta$, Line O'$R_d'$ includes Axis X by $\omega'=(\alpha-\theta)+i(\alpha-\Psi-\theta)$. Hence, as $i\neq1$, the formula for the engaged groove curve derives from Formula 5A as follows:

$$\begin{cases} X_n=(R_a+R_b)\mathrm{Cos}[i(\alpha-\Psi-n\theta)]-R_2\mathrm{Cos}[(\alpha-n\theta)+i(\alpha-\Psi-n\theta)] \\ Y_n=R_2\mathrm{Sin}[(\alpha-n\theta)+i(\alpha-\Psi-n\theta)]-(R_a+R_b)\mathrm{Sin}[i(\alpha-\Psi-n\theta)] \end{cases} \quad (7A)$$

The bottom curve of the engaged groove coincides with Formula 7B below:

$$\begin{cases} X=(R_a+R_b-R_2)\mathrm{Cos}(i\Psi) \\ Y=(R_a+R_b-R_2)\mathrm{Sin}(i\Psi) \quad (\Psi\rightarrow-\Psi) \end{cases} \quad (7B)$$

The curve coordinates of the working tooth can be deduced from Formula 6A as follows:

$$\begin{cases} X_n=(R_a+R_b)\mathrm{Cos}(\alpha-\Psi-n\theta)-R_{b1}\mathrm{Cos}[\alpha+\beta-\Psi-n(i\theta+\theta)] \\ Y_n=R_{b1}\mathrm{Sin}[\alpha+\beta-\Psi-n(i\theta+\theta)]-(R_a+R_b)\mathrm{Sin}(\alpha-\Psi-n\theta) \end{cases} \quad (8A)$$

The curve of the working tooth addendum thickness coincides with Formula 8B below:

$$\begin{cases} X=R_2\mathrm{Cos}\Psi \\ Y=R_2\mathrm{Sin}\Psi \quad (\Psi\rightarrow-\Psi) \end{cases} \quad (8B)$$

The gear ratio i>1 or i<1 referred to in FIGS. 7A and 7B as well as in Formulae 7A and 8A must meet the following requirements:

Along the circumference of one involute wheel, wheel A, must be uniformly distributed "na" working teeth while along that of the other (Wheel B) must be uniformly distributed "nb" engaged grooves;

The arc length defined by the angle "$\omega_{na}$" included between the working teeth and the radius "$R_a$" of the reference circle of the involute tooth on Wheel A must be equal to the arc length defined by the angle "$\omega_{nb}$" included between the engaged grooves and the radius "$R_b$" of the reference circle of the involute tooth on wheel B:

$$\frac{\pi R_a\omega_{na}}{180^\circ}=\frac{\pi R_b\omega_{nb}}{180^\circ};$$

-continued $$\omega_{na}=\frac{360^\circ}{n_a};\ \omega_{nb}=\frac{360^\circ}{n_b}$$

The following gives a detailed description of the embodiment of the ER (Engaged Rotor) which can be applied, e.g. in the refrigerator compressor.

Suppose Working Wheel A and Engaged Wheel B have the same number of tooth, equal modulus and compressing angle, with the gear ratio i=1.

The involute toothed wheel is designed as:

number of tooth Z=40;

modulus m=0.5;

pressure angle α=20°;

$$\text{reference circle radius } R=\frac{mZ}{2}=10;$$

$$\text{addendum circle radius } R_{b1}=\frac{m(Z+2)}{2}=10.5;$$

$$\text{dedendum circle radius } R_f=\frac{m(Z-2)}{2}=9.5$$

to reduce the tolerance volume between the teeth, the radial clearance

C is neglected here;

addendum circle radius of the working tooth $R_2$=13.6

Figure 9A:
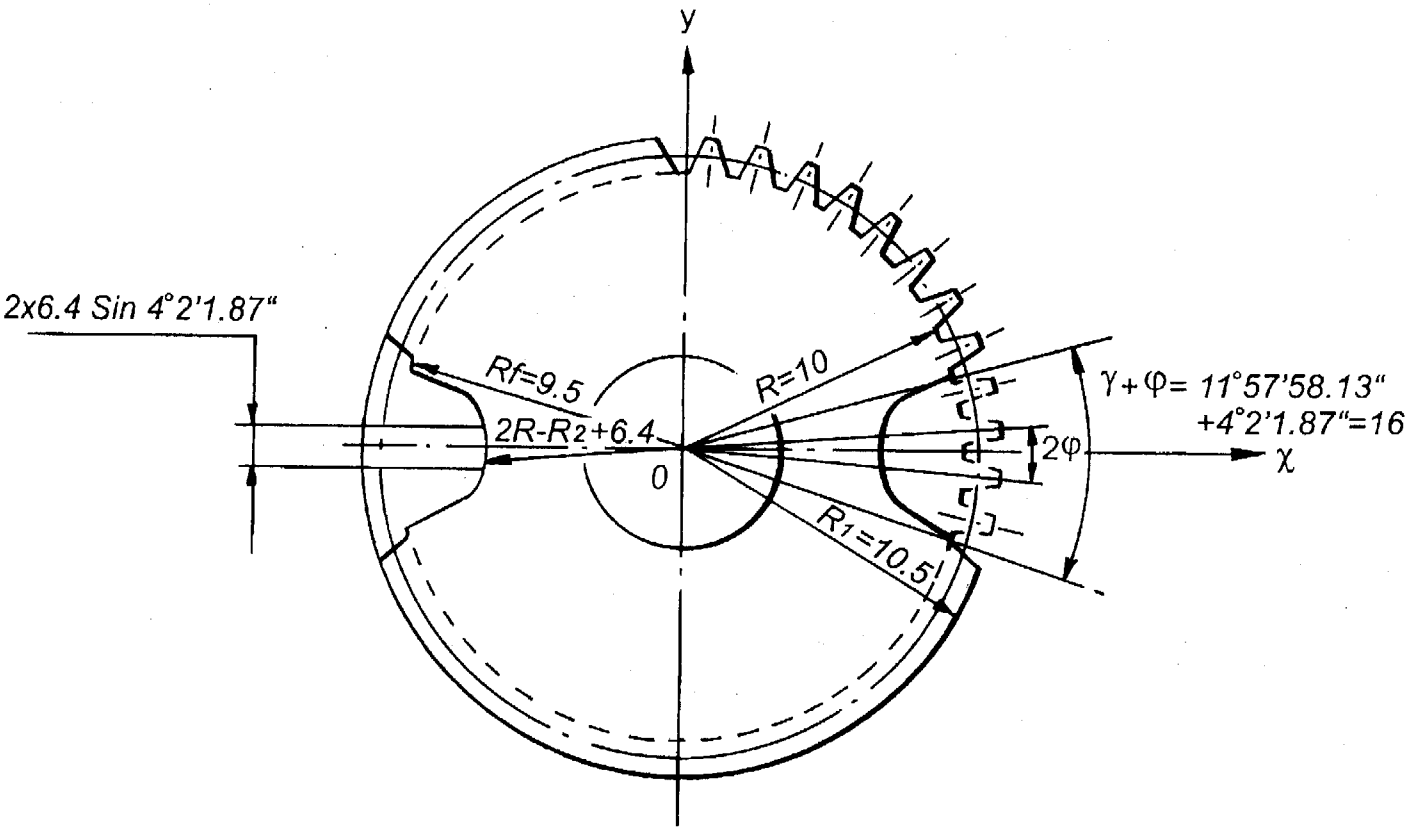
FIG. 9A: an embodiment of the structure and dimensions of the engaged wheel.
Figure 9B:
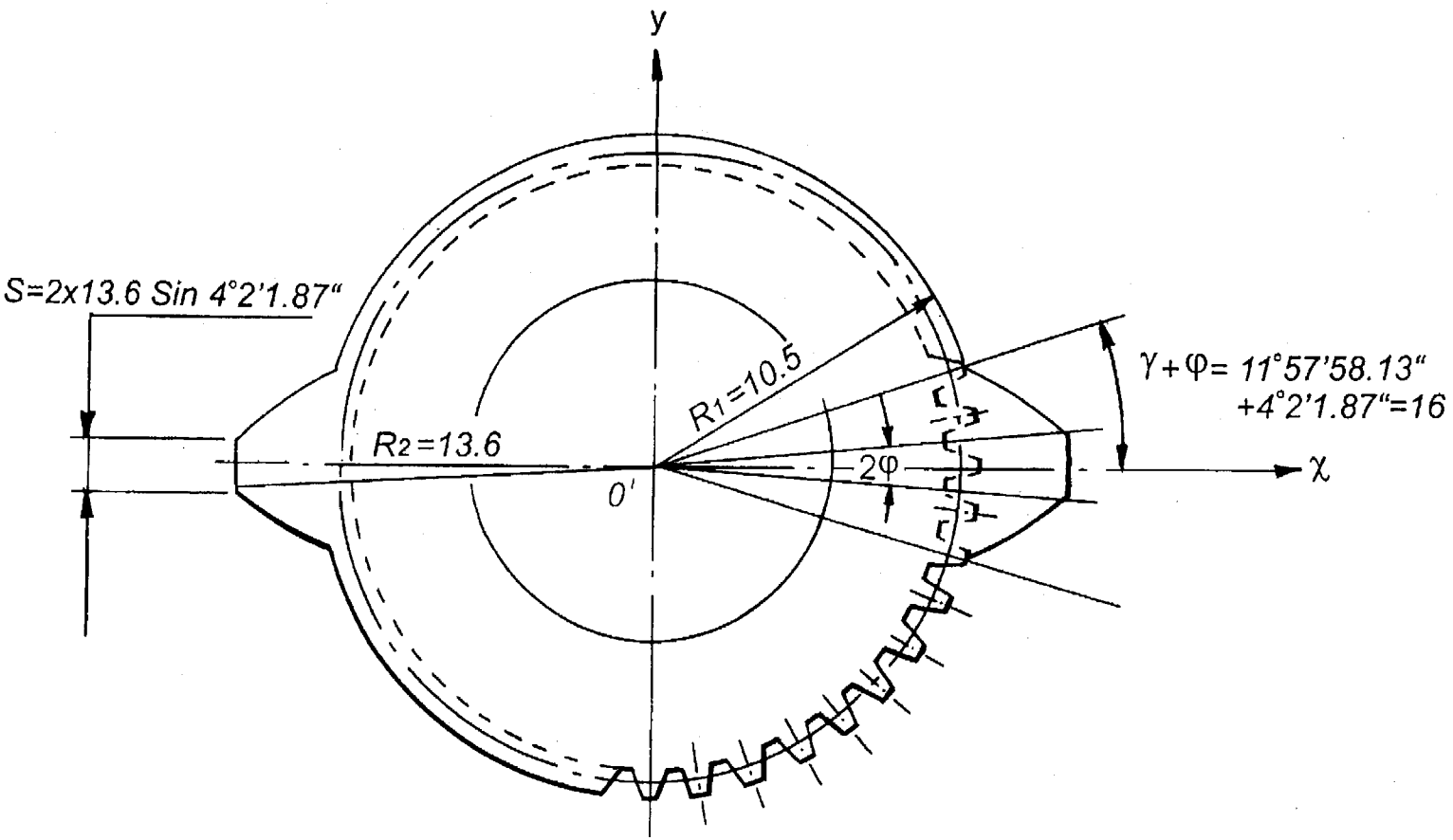
FIG. 9B: an embodiment of the structure and dimensions of the working wheel.

With regards to the intensity and integrity of the involute teeth on Wheel B, the engaged groove curve is designed to tolerate four teeth and the addendum circle of the working tooth is designed to have its radius go round the radius of the addendum circle of the involute tooth $R_{b1}$ and secant with the radius $R_f$ of the deddendum circle of Wheel B directly (refer to FIG. 9A).

Figure 8:
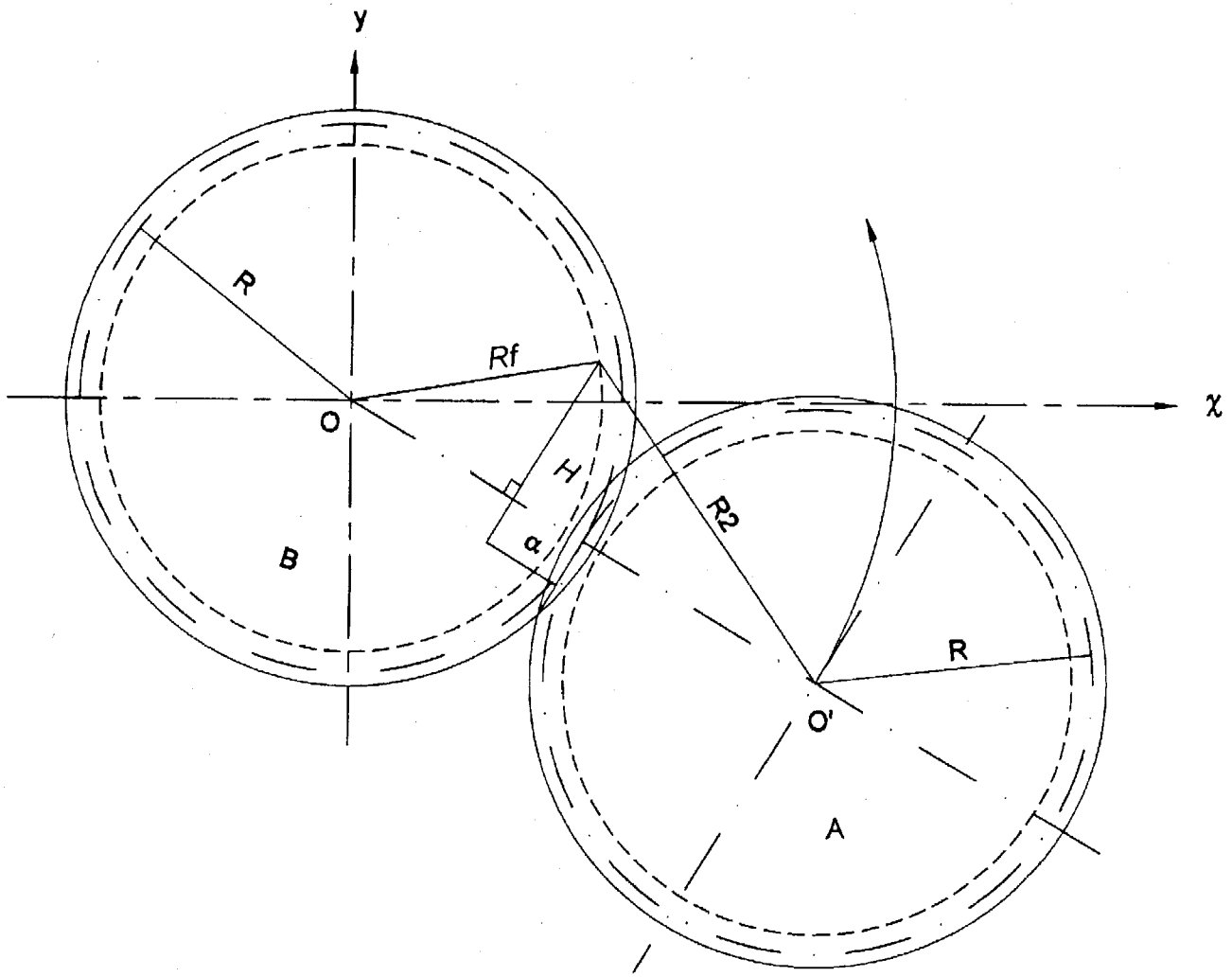

Draw a line that is perpendicular to and intersects Line O O' from the intersection point "D" by $R_2$ (radius of the addendum circle of the working tooth) with $R_f$ (radius of the dedendum circle of Wheel B), with "H" as the height from Point D to Line O O' (refer to FIG. 8). Then we have $$H^2=R_2^2-(R+a)^2,$$

$$H^2=R_f^2-(R-a)^2,$$

$$R_2^2-(R+a)^2=R_f^2-(R-a)^2,$$

the solution of which is a=2.36775.

$$\text{For } \mathrm{Cos}\alpha=\frac{R+a}{R_2}=\frac{10+2.36775}{13.6},$$

then α=24°34'42.04".

$$\text{For } \mathrm{Cos}\beta=\frac{R-a}{R_f},\ \mathrm{Cos}\beta=\frac{10-2.36775}{9.5},$$

then β=36°32'40.17".

Let θ=4°5'47.01" then K=6, n=0,1,2 . . . k, γ=β−α, γ=11°57'58.13".

Let the included angle of the addendum thickness of the working tooth Ψ=4°2'1.87" and the semiangle of the engaged groove is γ+Ψ=11°57'58.13"+4°2'1.87"=16°.

Substitute the above data into Formula 7A for the engaged groove curve:

$$\begin{cases} X_n = (R_a + R_b)\mathrm{Cos}[i(\alpha - \Psi - n\theta)] - R_2\mathrm{Cos}[(\alpha - n\theta) + i(\alpha - \Psi - n\theta)] \\ Y_n = R_2\mathrm{Sin}[(\alpha - n\theta) + i(\alpha - \Psi - n\theta)] - (R_a + R_b)\mathrm{Sin}[i(\alpha - \Psi - n\theta)] \end{cases}$$

then, $$\begin{cases} X_n = 20\mathrm{Cos}(24°34'42.04" - 4°2'1.87" - n4°5'47.01") - \\ \quad 13.6\mathrm{Cos}[2(24°34'42.04" - n4°5'47.01") - 4°2'1.87"] \\ Y_n = 13.6\mathrm{Sin}[2(24°34'42.04" - n4°5'47.01") - 4°2'1.87"] - \\ \quad 20\mathrm{Sin}(24°34'42.04" - 4°2'1.87" - n4°5'47.01") \end{cases}$$

If n=0, then $$\begin{cases} X_0 = 20\mathrm{Cos}(20°32'40.17") - 13.6\mathrm{Cos}(45°7'22.21") \\ Y_0 = 13.6\mathrm{Sin}(45°7'22.21") - 20\mathrm{Sin}(20°32'40.17") \end{cases}$$

If n=1, then $$\begin{cases} X_1 = 20\mathrm{Cos}(16°26'53.16") - 13.6\mathrm{Cos}(36°55'48.2") \\ Y_1 = 13.6\mathrm{Sin}(36°55'48.2") - 20\mathrm{Sin}(16°26'53.16") \end{cases}$$

. . . (omitted)

If n=6, then $$\begin{cases} X_6 = 20\mathrm{Cos}(-4°2'1.87") - 13.6\mathrm{Cos}(-4°2'1.87") \\ Y_6 = 13.6\mathrm{Sin}(-4°2'1.87") - 20\mathrm{Sin}(-4°2'1.87") \end{cases}$$

The rest coordinates of the angle Ψ corresponding to the included angle Ψ of the addendum thickness are based on the circle whose centre is Point O and radius $2R-R_2=6.4$, which are listed below:

| n | x | y | | |
|---|---|---|---|---|
| 0 | 9.132 | 2.619 | | |
| 1 | 8.310 | 2.508 | | |
| 2 | 7.612 | 2.261 | | |
| 3 | 7.058 | 1.901 | | |
| 4 | 6.662 | 1.459 | | |
| 5 | 6.436 | 0.964 | | |
| 6 | 6.384 | 0.450 | | |
| 2° | 6.396 | 0.255 | 6.4Cos2° | 6.4Sin2° |
| 0° | 6.400 | 0.000 | 6.4Cos0° | 6.4Sin0° |

As the engaged groove curve "L" is made up of points absolutely symmetrical with Axis X, by connecting the above points and drawing the symmetrical curve we then get the entire groove. Build the groove up in an involute toothed wheel, and we get the so-called engaged wheel, as is illustrated in FIG. 9A.

Now let us turn to look at the working tooth curve.

In Formula 8A, $$\theta = \frac{\beta}{n},$$

let θ=6°5'26.69", when n=1,2 . . . k, (k=6) and Rb1 is replaced by Rf.

$$\begin{cases} X_n = (R_a + R_b)\mathrm{Cos}(\alpha - \Psi - n\theta) - R_{b1}\mathrm{Cos}[\alpha_+ \beta_- \Psi_- n(i\theta_+ \theta)] \\ Y_n = R_{b1}\mathrm{Sin}[\alpha_+ \beta - \Psi_- n(i\theta_+ \theta)] - (R_{a+} R_b)\mathrm{Sin}(\alpha_- \Psi_- n\theta) \end{cases}$$

Substitute the above-mentioned data into Formula 8A: then we have $$\begin{cases} X_n = 20\mathrm{Cos}(24°34'42.04" - 4°2'1.87" - n6°5'26.69") - \\ \quad 9.5\mathrm{Cos}(24°34'42.04" + 36°32'40.17" - 4°2'1.87" - \\ \quad 2n6°5'26.69") \\ Y_n = 9.5\mathrm{Sin}(24°34'42.04" + 36°32'40.17" - 4°2'1.87" - \\ \quad 2n6°5'26.69") - 20\mathrm{Sin}(24°34'42.04" - 4°2'1.87" - \\ \quad n6°5'26.69") \end{cases}$$

If n=0, then $$\begin{cases} X_0 = 20\mathrm{Cos}(20°32'40.17") - 9.5\mathrm{Cos}(57°5'20.34") \\ Y_0 = 9.5\mathrm{Sin}(57°5'20.34") - 20\mathrm{Cos}(20°32'40.17") \end{cases}$$

If n=1, then $$\begin{cases} X_1 = 20\mathrm{Cos}(14°27'13.48") - 9.5\mathrm{Cos}(44°54'26.96") \\ Y_1 = 9.5\mathrm{Sin}(44°54'26.96") - 20\mathrm{Sin}(14°27'13.48") \end{cases}$$

If n=6, then $$\begin{cases} X_6 = 20\mathrm{Cos}(-16°) - 9.5\mathrm{Cos}(-16°) \\ Y_6 = 9.5\mathrm{Sin}(-16°) - 20\mathrm{Sin}(-16°) \end{cases}$$

The coordinates of the addendum thickness $S=2R_2\mathrm{Sin}\Psi$ is described by the circle whose centre is O' and radius is 13.6, as is shown below:

| n | x | y | | |
|---|---|---|---|---|
| 0° | 13.6 | 0 | 13.6Cos0° | 13.6Sin0° |
| 2° | 13.592 | 0.475 | 13.6Cos2° | 13.6Sin2° |
| 0 | 13.566 | 0.957 | | |
| 1 | 12.639 | 1.715 | | |
| 2 | 11.795 | 2.227 | | |
| 3 | 11.088 | 2.541 | | |
| 4 | 10.557 | 2.714 | | |
| 5 | 10.223 | 2.809 | | |
| 6 | 10.093 | 2.894 | | |

As the working tooth curves "J" and "J'" are absolutely symmetrical with Axis X, by connecting the above points and drawing its symmetrical curve we then get the working tooth. Build the working tooth up in the involute toothed wheel, then we get the working wheel.

The form of the involute toothed wheel can be done with traditional technology, so it is omitted here. The value of the set constant "θ" depends on the machining accuracy. The more accurate machining requires, the more points there will be; the smaller the value of "θ" is, the bigger the value of the natural number "k" will be.

INDUSTRIAL EFFECT

The Engaged Rotor Mechanism (ERM) consists of a casing, two side plates, the closed circular arc cavities formed by the engaged wheel and the working wheel, with the circumference plane of the engaged wheel as the supporting surface. When the working wheel starts to revolve, the volume of the two circular arc cavities which are separated by the working tooth varies periodically from big to small, therefore satisfying the essential requirements to produce pumps, motors and internal combustion engines.

By combining the pair of rotors presented in this Invention with the casing having inlet and outlet respectively and end covers, various fluid pumps can be produced, such as liquid pumps and gas pumps, as well as vacuum pumps and measuring pumps. The said rotors can also be used to produce liquid motor or a kind of special rotor internal combustion engines. As the forms of the working tooth and the engaged groove on the rotors according to the present invention are defined by special functions which result from the engaged rotation of the involute toothed wheel, the characteristics of the involute teeth are then true with the working tooth and the engaged groove during the course of engaged rotation.

What is claimed is:

1. An engaged rotor mechanism comprising:

a casing;

an engaged wheel disposed within said casing and having a plurality of involute teeth and at least one engaged tooth groove disposed about an excircle circumference thereof, said at least one engaged tooth groove having a depth greater than a height of said involute teeth;

a working wheel disposed within said casing and engaging said engaged wheel, said working wheel and said engaged wheel rotating within said casing, said working wheel having a plurality of said involute teeth and at least one working tooth disposed about an excircle circumference thereof, said at least one working tooth having a height greater than said height of said involute teeth, said at least one working tooth of said working wheel meshing with said at least one engaged tooth groove of said engaged wheel during rotation of said wheels, and said involute teeth of each of said wheels meshing with said involute teeth of the other of said wheels during rotation of said wheels;

said at least one working tooth of said working wheel having a shape defined by the following function formula:

$$\begin{cases} X_n = (R_a + R_b)\mathrm{Cos}(\alpha - \Psi - n\theta) - R_{b1}\mathrm{Cos}[\alpha + \beta - \Psi - n(i\theta + \theta)] \\ Y_n = R_{b1}\mathrm{Sin}[\alpha + \beta - \Psi - n(i\theta + \theta)] - (R_a + R_b)\mathrm{Sin}(a - \Psi - n\theta); \end{cases}$$

said working tooth having an addendum thickness, wherein a curve of said addendum thickness is defined by a circular arc corresponding to the included angle $2\Psi$ and with said circular arc having a center corresponding to a center of said working wheel and a radius equal to $R_2$, said circular arc being defined by the following formula:

$$\begin{cases} X = R_2\mathrm{Cos}\Psi \\ Y = R_2\mathrm{Sin}\Psi \qquad (\Psi \to -\Psi); \end{cases}$$

wherein in the above equations,

"$R_a$" stands for the radius of the reference circle of the involute tooth on Wheel A;

"$R_b$" stands for the radius of the reference circle of the involute tooth on Wheel B;

"$R_2$" stands for the radius of the addendum circle of the working tooth on Wheel A;

"$R_{b1}$" stands for the radius of the addendum circle of the involute tooth on Wheel B;

"a" stands for the distance between the intersection point of the line past Point "$R_d$" perpendicular to Line O O' and the point of tangency of Circle $R_a$ with Circle $R_b$;

"i" stands for the gear ratio;

"$\Psi$" stands for the semiangle of the working tooth addendum thickness;

"$\theta$" stands for a set constant;

"n" stands for n=0,1,2, . . . k, in which "k" is a natural number;

"$\alpha$" stands for $$\mathrm{arc}\frac{\mathrm{Cos}\,R_a + a}{R_2};$$

"$\beta$" stands for $$\mathrm{arcCos}\frac{R_b - a}{R_{b1}}.$$

2. The engaged rotor mechanism as recited in claim 1, wherein said engaged tooth groove has a shape which is defined by the following function formula:

$$\begin{cases} X_n = (R_a + R_b)\mathrm{Cos}[i(\alpha - \Psi - n\theta)] - R_2\mathrm{Cos}[(\alpha - n\theta) + i(\alpha - \Psi - n\theta)] \\ Y_n = R_2\mathrm{Sin}[(\alpha - n\theta) + i(\alpha - \Psi - n\theta)] - (R_a + R_b)\mathrm{Sin}[i(\alpha - \Psi - n\theta)] \end{cases}$$

said shape having a bottom curve defined by a circular arc included by the angle $2i\Psi$ corresponding to the included angle $2\Psi$ of the addendum thickness and with the circle center which is that of the engaged wheel as the center, the radius $R_a+R_b-R_2$ as the radius, said circular arc being defined by the following formula:

$$\begin{cases} X = (R_a + R_b - R_2)\mathrm{Cos}(i\Psi) \\ Y = (R_a + R_b - R_2)\mathrm{Sin}(i\Psi) \qquad (\Psi \to -\Psi). \end{cases}$$

3. The engaged rotor mechanism as recited in claim 2, wherein:

said at least one engaged tooth groove of said engaged wheel comprises a plurality of said engaged tooth grooves;

said at least one working tooth of said working wheel comprises a plurality of said working teeth; and said working teeth of said working wheel engage said engaged tooth grooves of said engaged wheel during rotation of said wheels.

4. The engaged rotor mechanism as recited in claim 3, wherein:

said engaged tooth grooves are equally spaced from one another;

said working teeth are equally spaced from one another;

the number of said engaged tooth grooves is equal to the number of said working teeth.

5. The engaged rotor mechanism as recited in claim 2, wherein:

said engaged wheel includes a plurality of said engaged tooth grooves and a plurality of said working teeth;

said working wheel includes a plurality of said working teeth and a plurality of said engaged tooth grooves.

6. The engaged rotor mechanism as recited in claim 3, wherein:

said engaged tooth grooves are equally spaced from one another;

said working teeth are equally spaced from one another;

the number of said engaged tooth grooves is unequal to the number of said working teeth.

* * * * *